United States Patent [19]

Baldo et al.

[11] Patent Number: 4,992,113

[45] Date of Patent: Feb. 12, 1991

[54] PROCESS FOR HEAT TREATMENT UNDER A GASEOUS ATMOSPHERE CONTAINING NITROGEN AND HYDROCARBON

[75] Inventors: Pascal Baldo, Sceaux; Eric Duchateau, Versailles, both of France

[73] Assignee: L'Air Liquide, Societe Anonyme Pour L'Etude et L'Exploitation des Procedes Georges Claude, Paris, France

[21] Appl. No.: 571,022

[22] Filed: Aug. 22, 1990

Related U.S. Application Data

[63] Continuation of Ser. No. 266,092, Nov. 2, 1988, abandoned.

[30] Foreign Application Priority Data

Nov. 17, 1987 [FR] France ..... 87 15860

[51] Int. Cl.[5] ..... C21D 1/76; C21D 11/00; C21D 9/08

[52] U.S. Cl. ..... 148/160; 148/16.5; 148/16.7; 148/128

[58] Field of Search ..... 148/16, 16.5, 16.7, 148/128

[56] References Cited

U.S. PATENT DOCUMENTS

| | | | |
|---|---|---|---|
| 2,815,305 | 12/1957 | Ipsen | 148/16 |
| 3,201,290 | 8/1965 | Wyss | 148/16.5 |
| 4,049,472 | 9/1977 | Arndt | 148/16 |
| 4,211,584 | 7/1980 | L'Hermite et al. | 148/167 |
| 4,372,790 | 2/1983 | Göhring et al. | 148/16.5 |
| 4,386,972 | 7/1983 | Knight | 148/16.7 |
| 4,445,945 | 5/1984 | Schwalm | 148/16 |
| 4,769,090 | 9/1988 | Queillle | 148/16 |

FOREIGN PATENT DOCUMENTS

| | | |
|---|---|---|
| 2016698 | 9/1979 | United Kingdom . |
| 2044804 | 10/1980 | United Kingdom . |

OTHER PUBLICATIONS

Chem. Abs. 86:20430u, Heat Treatment of Steel Articles Without Formation of Surface Oxides of the Alloying Elements, 9/76, Werner Goehring.

Chem. Abs. 95:101157y, Calculation of the Equilibrium Composition of Blended Gases for Heat Treating Furnace Atmospheres, 6/79, C. A. Stickels.

Chem. Abs. 90:172648s, Protective Gas for the Heat Treatment of Ferrous Metals, 3/79, Wolfgang Trappmann.

Abstract of Japanese Patent J59001626, 1/84.

*Metals Handbook*, 9th ed; vol. 4; ASM, pp. 361-366, Nov. 1981.

*Primary Examiner*—R. Dean

*Assistant Examiner*—Margery S. Phipps

*Attorney, Agent, or Firm*—Curtis, Morris & Safford

[57] ABSTRACT

Process for the heat treatment of low-alloy steels at temperatures higher than 600° C., such as annealing or heating before hardening, etc., said treatment being carried out in a protection atmosphere produced by the injection of nitrogen, hydrocarbon $C_xH_y$ and optionally hydrogen, with a control of the atmosphere. According to the invention, the composition of the residual species $CH_4$, CO, $H_2O$, and the temperature of the gaseous mixture in the furnace are controlled in order to control the carburization and the decarburization of the treated steels.

21 Claims, 2 Drawing Sheets

PROCESS FOR HEAT TREATMENT UNDER A GASEOUS ATMOSPHERE CONTAINING NITROGEN AND HYDROCARBON

This application is a continuation of application Ser. No. 266,092, filed Nov. 2, 1988 now abandoned.

The present invention relates to a process for heat treatment of non-alloyed steels or low-alloy steels at temperatures higher than 600° C., such as annealing, tempering, heating before hardening etc . . . , said treatment being carried out in an atmosphere containing at least nitrogen, a hydrocarbon $C_xH_y$, and possibly hydrogen, said atmosphere being produced by the injection of these products into the furnace.

In the heat treatment of low-alloy steels at temperatures higher than 600° C. (annealing, tempering, heating before hardening, etc.), atmospheres of the type $N_2(+H_2)+C_xH_y$ are used for protecting the steel. In this type of treatment, the specification imposes a more or less large limitation of the decarburization. Now, it is found that atmospheres of the type described hereinbefore are never at thermodynamic equilibrium in the usual treatment times, which renders impossible any calculation of the activity of the carbon in the atmosphere and consequently any attempt to forecast the carburization or decarburization of the work pieces, and the a priori control of the treatment. At the present time, there is determined empirically for each furnace and each type of treatment an atmosphere composition which is such that the limitations of the specification may be respected. The process employed is often the following:

The experimenter arbitrarily chooses a flow and a composition of $N_2$, $H_2$, $C_xH_y$. He carries out a test and, as the case may be, modifies the flow and the quantity of $C_xH_y$ in order to try to obtain a dew point which is lower than an empirical value (often −25° C.). The examination of the treated metallurgical samples shows him if his choices have been judicious. In the negative, he recommences and tries to obtain a lower dew point.

The process employed at the present time in practice results from a purely empirical procedure whose results are valid solely for a specific treatment.

These results depend on a multitude of parameters: time, temperature, the grade of the steel, the instantaneous sealing of the furnace, the condition in which the furnace has been put, etc.

For each type of treatment and each furnace, the experimenter must recommence his tests. Any subsequent modification of a treatment may give bad metallurgical results.

The awkwardness of the procedure involves a real non-optimization of the flows and composition of the atmosphere which might render the use of synthetic gases of prohibitive cost, consequently leading to the use of endothermic or exothermic generators.

When an atmosphere of the endothermic type is used (essentially rich in $N_2$, CO, $H_2$) there is obtained a mixture of the following gases: $N_2$, CO, $CO_2$, $H_2O$, $C_xH_y$. This type of atmosphere permits a cementation of the work pieces, i.e. an enrichment with carbon on the surface of said work pieces. These gases are generally in thermodynamic equilibrium with respect to one another except with the hydrocarbons present (mainly $CH_4$). This situation is not prejudicial to a control of the atmosphere on the treated work pieces, based on the existence of a thermodynamic equilibrium, since these hydrocarbons cannot have a direct action on the metal in the presence of a large quantity of CO (for example $CO/CH_4>25$). Indeed, in this case the hydrocarbons do not participate in the transfer of the carbon from the gaseous mixture to the surface of the metal but solely react in a gaseous phase. Therefore, only the gases of the mixture in thermodynamic equilibrium govern the action of the atmosphere on the treated work pieces.

In the use of a mixture $N_2(+H_2)+C_xH_y$ for applications such as those described hereinbefore, the same gases are obtained but in different proportions ($0.05<CO/CH_4<15$—preferably $CO/CH_4$ is substantially equal to 1, the respective contents of CO and $CH_4$ being preferably in the neighbourhood of 1%). In this case, the hydrocarbon or hydrocarbons present may directly participate in the exchanges of carbon with the metal. It is therefore no longer possible to consider solely the thermodynamic equilibriums for controlling the gas-metal carbon transfers.

The invention is based on an experimental knowledge of the laws of transfer of the carbon between the surface of a low-alloy steel and a gaseous mixture applied for the protection. The study of these laws has resulted in the conclusion that the surface flow of carbon (such as defined in FICK's 1st law) principally depends on the temperature and residual concentrations (or partial pressures) of the gases CO, $CH_4$ $H_2O$ produced by the injection of a mixture $N_2+C_xH_y$ (and possibly $H_2$) into a furnace.

Generally, the specification imposes a required or set surface flow of carbon (through the surface of the treated work piece) which represents the tolerance of the decarburization of the work piece to be treated. This required or set flow F, the temperature, and the residual contents of CO and $CH_4$ measured in the furnace are entered in a calculator or computer which calculates from an established formula in accordance with experimental laws of the transfer of carbon at the gas-metal interface, a dew point (physical magnitude). This new required or set dew point (which is therefore variable, since it is a function of the composition of the atmosphere) is applied to a control of the PID (proportional, integral, derivative) type which acts on the flow of the atmosphere injected into the furnace. Preferably, this control is effected with two adjustable magnitudes which are the flow of nitrogen and the flow of hydrocarbon so that the residual content of $CH_4$ permits minimizing the flow of nitrogen.

A better understanding of the invention will be had from the following non-limitative examples with reference to the drawings, in which:

The knowledge of the exchanges of carbon between the surface of a steel work piece and a gaseous mixture of a protection atmosphere $N_2+C_xH_y$ (with a possible addition of $H_2$) is based on the statistical utilization of the results of an experimental plan. This experimental plan permits measuring a profile of concentration of carbon in low-alloy steel work pieces (less than 5% metal alloy element) treated in a furnace and thus calculating a group of surface flows of carbon with atmospheres of a composition ranging within previously-determined limits. It is of course possible to employ any other method of calculating (other than an experimental plan) the surface flows in a theoretical manner which is outside the scope of the present invention or by the use empirical formulae.

As an example, the limits of this experimental plan may be the following:

680° C. < T < 1050° C.

residual content of $CH_4$ < 2.5%.

residual content of CO < 2.0%.

40 ppm < residual content of $H_2O$ < 1600 ppm (namely −50° C. < dew point < −15° C.).

residual content of hydrogen < 5%.

residual content of $CO_2$ < residual content of $H_2O$.

The residual content of a compound (or partial pressure of this compound) is intended to mean the content of this compound measured at a point of the furnace where the decomposition of the injected gases has already occurred.

The surface flow of carbon represents the unknown quantity in the solution of FICK's equations. Obtaining by successive approximations a carbon profile calculated by solving FICK's equations superposable on the carbon profile obtained by metallurgical analysis of the treated work piece permits finding this unknown flow parameter. The expression of FICK's equations as a dimension is the following:

FICK's 1st law $$J = -D\frac{(dc)}{(dx)_{x=0}} \quad \text{(Equality of the flows of surface and surface diffusion)}$$

FICK's 2nd law $$\frac{dc}{dt} = -\frac{dF}{dx}$$

$$\text{with } F = \text{diffusion flow} = -D\frac{dc}{dx}$$

c: content of carbon (% mass).

x: distance to the surface.

D: coefficient of diffusion of the carbon in the low-alloy steel work piece.

This experimental plan is carried out in the manner described by the following table:

| Za Temperature | Zb CO | Zc $CH^4$ | Zd $H_2O$ |
|---|---|---|---|
| − | − | − | − |
| + | − | − | − |
| − | + | − | − |
| − | − | + | − |
| − | − | − | + |
| + | + | − | − |
| + | − | + | − |
| + | − | − | + |
| − | + | + | − |
| − | + | − | + |
| − | − | + | + |
| + | + | + | − |
| + | + | − | + |
| + | − | + | + |
| − | + | + | + |
| + | + | + | + |

The signs + and − respectively designate for each factor Za, Zb, Zc, Zd (respectively the temperature and the residual contents of CO, $CH_4$, $H_2O$ (dew point)) a high value Za+, Zb+, Zc+, Zd+ and a low value Za−, Zb−, Zc−, Zd− such that Za− < Za < Za+ (etc . . . ), with Za− and Za+ within the limits fixed hereinbefore for the parameters of the atmosphere (temperature and residual contents of CO, $CH_4$, $H_2O$).

Figure 1:
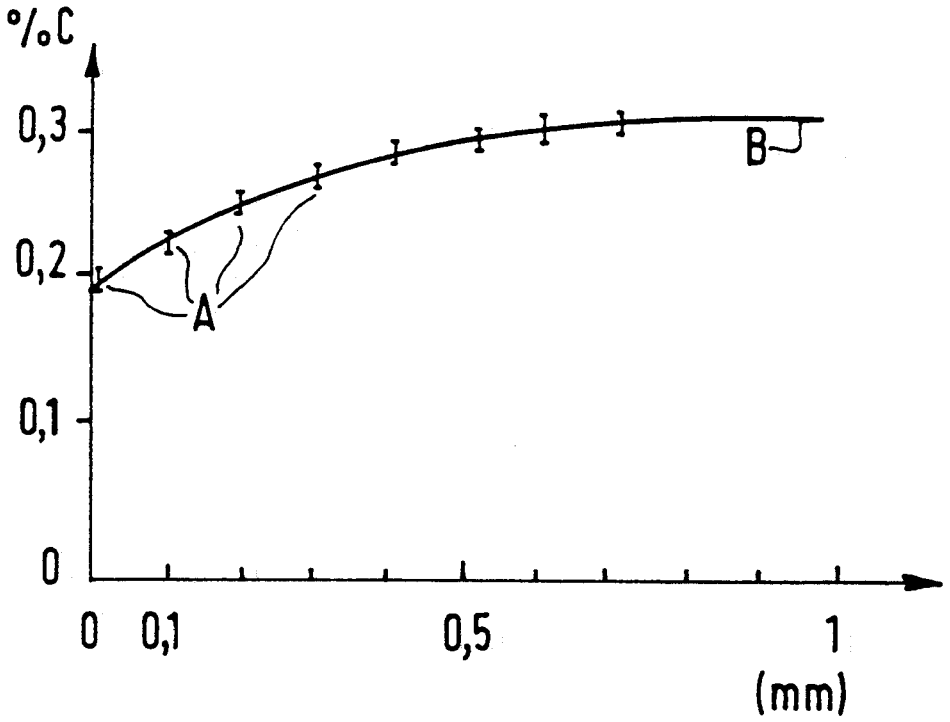
FIG. 1 represents a curve of the profile of carbon concentration of a work piece afer treatment.

Each line of the table gives the parameters of an atmosphere in which an experiment has been carried out. This experiment comprises reproducing this atmosphere in a furnace and maintaining a low-alloy steel sample therein during a given period of time. Thereafter, the spectrographic analysis of the treated work piece (spark spectrography, luminescent spectrography . . . ) gives the profile of concentration of carbon (FIG. 1 discrete points (A)); the latter is reproduced by the calculation (FIG. 1 continuous curve (B)) by solving FICK's equations which correspond to the experiment, by successive approximations of the value of the condition at the limit constituted by the surface of the treated steel. This value corresponds to the desired surface flow of the carbon at the gas-metal interface (hereinafter termed required or set flow F).

The application of YATES' algorithm (YATES. F., "DESIGN AND ANALYSIS OF FACTORIAL EXPERIMENTS", IMPERIAL BUREAU OF SOIL SCIENCE (LONDON 1937)) to this experimental plan 2 leads to the expression of the following linear combination which analytically describes the surface flow F of carbon of a work piece as a function of the factors temperature and residual contents in the furnace of $CH_4$, CO and $H_2O$:

$$F = P_0 + P_1 \cdot X_a + P_2 \cdot X_b + P_3 \cdot X_c + P_4 \cdot X_d + P_5 \cdot X_a \cdot X_b + P_6 \cdot X_a \cdot X_c + P_7 \cdot X_a \cdot X_d + P_8 \cdot X_b \cdot X_c + P_9 \cdot X_b \cdot X_d + P_{10} \cdot X_c \cdot X_d + P_{11} \cdot X_a \cdot X_b \cdot X_c + P_{12} \cdot X_a \cdot X_b \cdot X_d + P_{13} \cdot X_a \cdot X_c \cdot X_d + P_{14} \cdot X_b \cdot X_c \cdot X_d + P_{15} \cdot X_a \cdot X_b \cdot X_c \cdot X_d$$

$$X_a = \frac{Za - \frac{Za^- + Za^+}{2}}{\frac{Za^+ - Za^-}{2}}$$

Xb, Xc and Xd being defined respectively in the same way relative to Zb+, Zb−; Zc+, Zc−; Zd+, Zd−; respectively. $X_a$, $X_b$, $X_c$, $X_d$ are the reduced centred coordinates of the parameters of the atmosphere (temperature CO, $CH_4$, $H_2O$), between −1 and +1.

a represents the index of temperature T.

b represents the index of CO.

c represents the index of $CH_4$.

d represents the index of $H_2O$.

The coefficients P0 to P15 of the linear combination are the mean effects of each factor and their interactions. Mean effect is intended to mean, for each factor combination, the mean of the 16 responses weighted by the products of the levels +1 or −1 taken by the factors of the combination in each of the atmospheres relating to the responses.

The application of an analysis of the variance to the results of the experimental plan permits checking whether all the effects are significant. Those not significant are ignored.

The experimental plan may be carried out with any specimens of non-alloyed steel or low-alloy steel and permits determining the equation of the surface flow F of carbon which may be subsequently applicable to different types of work pieces to be treated in the furnace. The nature of the specimens of the experimental plan is not related to that of the work pieces subsequently treated in the furnace.

The surface flow of carbon is therefore a function of the temperature and the residual concentrations of CO, $H_2O$ and $CH_4$ and this function comes from the utilization of the results of the aforementioned experimental plan.

With this equation, several types of control over the residual gases become available.

The dew point is the magnitude which has the most effect on the flow of carbon. An increase in the dew point increases the decarburization of the work piece; a decrease in the dew point reduces the decarburization of the work piece.

On the other hand, it has been found that the action of the residual gases CO and $CH_4$ in the gaseous mixture is not univocal and may tend to increase or decrease the decarburization in different conditions.

In order to control the surface flow of carbon (carburization or decarburization or protection), the magnitude to be controlled is therefore the dew point.

The preferential mode of the control of the chosen atmosphere is the following:

The specification imposes a set flow $F_s$ (carbon through the surface of the work piece) which is entered in a calculator or computer; this set flow $F_s$ is calculated as indicated hereinbefore.

The permanent analysis of the atmosphere of the furnace indicates the temperature and the residual contents of $CH_4$ and CO which are automatically recorded by the computer (together with the concentration of $H_2O$, i.e. the measured dew point $DP_m$).

The expression of the flow $F=f(T, CH_4, CO, H_2O)$ contained in the memory of the computer is applied for calculating the value of the dew point $DP_s$ (equivalent to $X_d$ when $F=F_s$) which would give a flow F equal to the set flow $F_s$. The set flow is therefore converted into a set dew point $DP_s$ which varies with the composition of the atmosphere which is regularly sampled.

The value of the measurement of the dew point $DP_m$ given by the permanent analysis of the atmosphere of the furnace is compared with the regularly calculated value $DP_s$, generally after each sampling. The result of this comparison causes, owing to the action of a control of the type PID, either the maintenance of the flow $\mu_2+C_xH_y$ if $DP_s=DP_m$;

or the increase of this flow if $DP_s<DP_m$;

or the decrease of this flow if $DP_s>DP_m$.

The dew point is controlled by a variation of the flow of nitrogen. The nitrogen eliminates the water in the furnace by dilution (law of the type $c=c_oe^{(-dt/v)}$ with $c_o$ the concentration of initial water, c the concentration of water at time t, d the gaseous flow, t the duration and v the volume of the furnace), without having a contrary effect. Varying the nitrogen flow therefore permits controlling the dew point of the furnace.

On the other hand, it was found that the dew point was not controlled by varying the flow of injected hydrocarbon $C_xH_y$. Indeed, the hydrocarbon reacts on the water and drys the furnace but it also reacts with the oxides present in the furnace and forms water. These concurrent reactions do not permit a control of the atmosphere by a variation of the flow of $C_xH_y$.

But the control of the nitrogen flow has an effect on the value of the dew point $DP_s$ which represents the set flow $F_s$. Indeed, a variation in the flow of nitrogen injected into the furnace causes a dilution or a concentration of the residual contents of $CH_4$ and CO taken into account in the expression $F_s=f(T, CH_4, CO, H_2O)$ which serves to convert the set flow $F_c$ into the dew point $DP_s$.

Consequently, this variation of the set dew point $DP_s$ may be limited by imposing such conditions that the content of residual $CH_4$ varies but slightly as a function of the nitrogen flow.

For this purpose, two preferential solutions exist:

A first solution consists in adjusting the proportions of $C_xH_y$ as a function of the nitrogen flow so that a substantially constant residual $CH_4$ is obtained. For example, the proportions of $C_xH_y$ will be determined for the low and high nitrogen flows and the intermediate nitrogen flows will be obtained by interpolation.

A second solution consists in employing a control of the PID type of the concentration of residual $CH_4$ by imposing a set value for the concentration of residual $CH_4$. There may be found, with the flow equation:

$$F=f(T, CO, CH_4, H_2O)$$

a concentration of residual $CH_4$ which, for a given set flow $F_s$, permits calculating a maximum set dew point $DP_s$: controlling the atmosphere around this set value permits minimizing the flow of nitrogen injected into the furnace.

The fixing of this set value of residual $CH_4$ is effected either manually by the operator or preferably by calculation by the computer which searches the set value of the residual $CH_4$ which gives the highest calculated dew point.

In the case of a discontinuous furnace, it is preferable to put the latter previously in condition. By the injection of hydrogen at a temperature lower than that at which the $C_xH_y$ starts to react with the water, the furnace may be put in such condition that it has the lowest possible amount of oxides in the furnace when the $CH_4$ is injected, which therefore reduces the risk of formation of water by reduction of $C_xH_y$.

Figure 2:
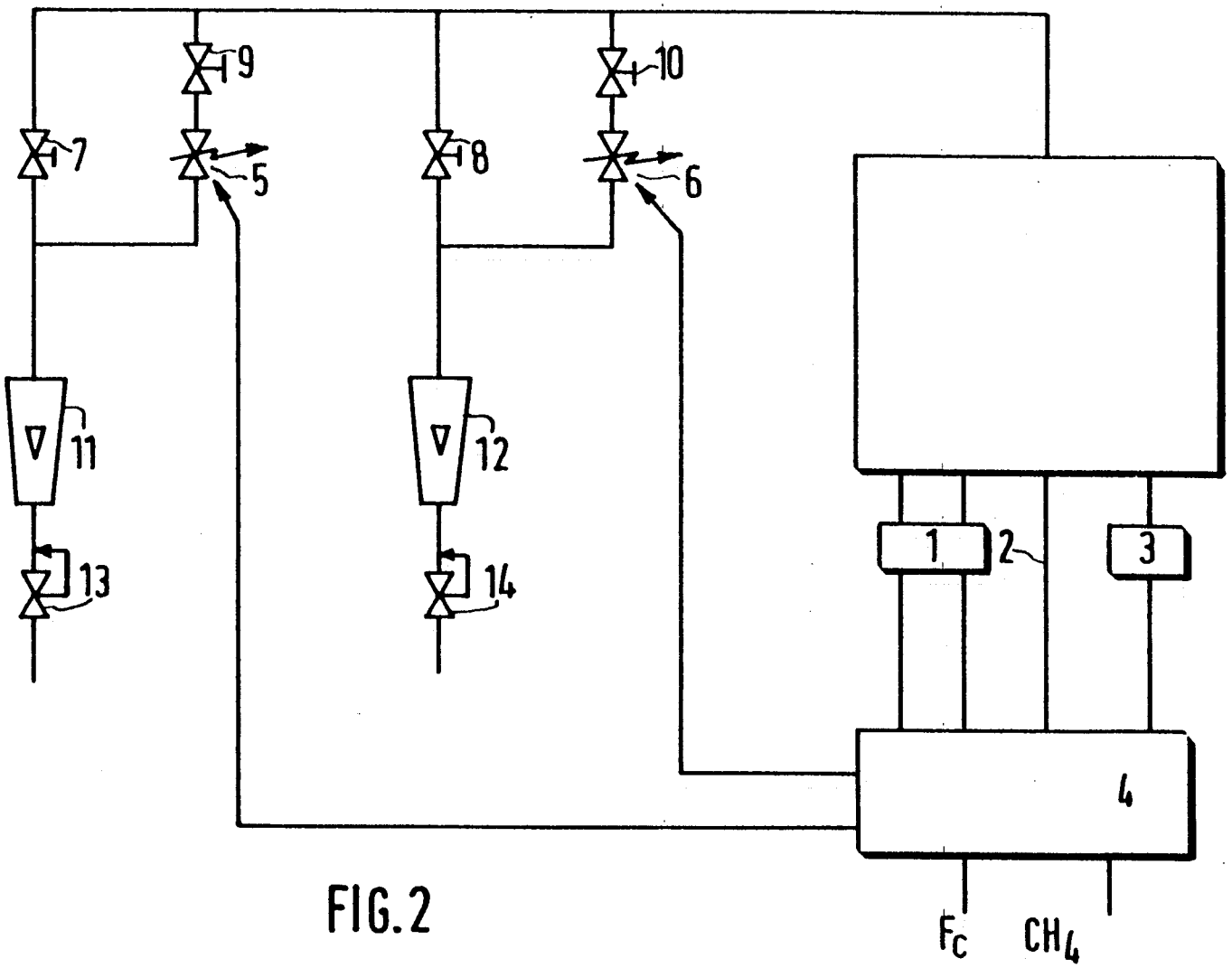
FIG. 2 represents a diagram of a device for controlling a furnace.

FIG. 2 shows the diagram of the principle of an atmosphere control whereby the process of the invention may be carried out. The infrared analyzer 1 analyzes the residual contents of $CH_4$ and CO; the temperature is measured by a thermocouple 2. The analyzers and the thermocouple are connected to a computer 4 which periodically receives the temperature of the gaseous mixture and the residual concentrations of $CH_4$ and CO. The equation $F=f(T, CH_4, CO, H_2O)$ stored in the memory of the computer permits, with the measurements of T, $CH_4$, and CO, calculating the dew point $DP_s$ which gives a flow equal to the set flow. This set dew point $DP_s$ is compared with the value of the dew point $DP_m$ measured in the furnace by a hygrometer 3. The error signal is sent into a control of type PID which controls two electrically-operated valves 5 and 6 and calculates their respective opening times. The table of the distribution of the nitrogen and the hydrocarbon $C_xH_y$ operates in accordance with a double flow, a low flow, which may be zero, and a high flow. When the valves 5 and 6 are closed, the low flows of nitrogen and $C_xH_y$ are controlled by means of valves 7 and 8. It is possible to adjust for a low flow of nitrogen the proportion of $C_xH_y$ injected to obtain a set residual content of $CH_4$. When the valves 5 and 6 are opened, complementary flows of nitrogen and hydrocarbon $C_xH_y$ are adjusted by the valves 9 and 10. It is then possible to control the proportion of $C_xH_y$ injected for obtaining the set residual content of $CH_4$ for a high nitrogen flow. The reading of the flows of nitrogen and $C_xH_y$ is carried out by rotameters 11 and 12. The pressure reducers 13 and 14 permit regulating the pressure in the rotameters for a correct reading of the flows. The residual content of $CH_4$ in the furnace may also be maintained constant by a PID control. The residual content of $CH_4$ (or the set residual content of $CH_4$) is imposed manually by the operator or produced by the computer for minimizing the flow of nitrogen injected into the furnace, as described before.

It will be observed that the device according to the invention comprises electrically operated valves 5 and 6 controlled by the computer 4 and manually controlled valves 7, 8, 9 and 10. Indeed, it is desired, in accordance with the invention, to maintain a constant residual content of $CH_4$ in the atmosphere of the furnace. It has been found that this was not always possible when the flow of nitrogen and hydrocarbon $C_xH_y$ injected into the furnace varied with a constant ratio $(C_xH_y)/(N_2)$. Consequently, in some cases it may be necessary to be in a position to vary the ratio $(C_xH_y)/(N_2)$ to conserve under all circumstances a constant concentration of residual $CH_4$.

Two variants according to the invention are as follows:

A first variant in which a value of residual $CH_4$ is fixed manually without control of the residual $CH_4$: for this purpose there is effected a first manual control of the low flows by means of valves 7 and 8, taking into account a prior calculation or an empirical estimation of the residual $CH_4$ to be obtained in the furnace. The control of the ratio $(C_xH_y)/(N_2)$ in the case of the low flow is terminated when the measured residual $CH_4$ reaches about the desired value. A second manual control of the high flows is then effected by means of the valves 9 and 10, as a function of the residual $CH_4$ to be maintained (as before). The control of the ratio $(C_xH_y)/(N_2)$ in the case of the high flow is terminated when the measured residual $CH_4$ reaches about the desired value. The ratios $(C_xH_y)/(N_2)$ are not necessarily the same for the low and high flows. However, they are controlled once and for all.

In this first variant, there is no control of the residual $CH_4$ (no set $CH_4$—see the Figure).

In this variant, the electrically-operated valves 5 and 6 are opened simultaneously.

A second variant in which a set value "set $CH_4$" is fixed with which a second control loop is realized and controlled by the computer. The latter compares the measured value of the residual $CH_4$ with the set value:

if the residual $CH_4$ is less than the set $CH_4$, the computer orders an increase in the opening time of the valve 6 (increase in the flow of injected $C_xH_y$, since there is an increase in the duration of the high flow of $C_xH_y$);

if the residual $CH_4$ = the set $CH_4$, the opening times are maintained;

if the residual $CH_4$ > the set $CH_4$, the opening time of the valve 6 is reduced (and consequently the duration of the high flow is reduced).

The dew point is checked ($DP_m = DP_s$) in a similar manner in a single nitrogen channel by means of the electrically-operated valve 5 whose opening time is more or less long depending on whether the duration of the high flow of nitrogen must be increased or decreased.

The opening and closing of the two valves 5 and 6 are therefore no longer necessarily simultaneous.

EXAMPLE

There will be shown hereinafter the manner in which the invention is used when one is confronted with a technical problem posed by a user.

The user defines a specification from which are deduced the limits of the experimental plan defined hereinbefore so as to determine the flow equation which will then be stored in the memory of the computer. The aforementioned experimental plan is of course only one possible example of the determination of the flow equation. Any other simplified, approximate or theoretical means is of course possible. In particular, this equation may also be determined empirically or in a purely theoretical manner.

After this flow equation $F = f(T, CH_4, CO, H_2O)$, has been determined, the set flow $F_s$ is determined which represents a mean decarburization tolerance which is acceptable for the treatment of the work pieces of the user. This set flow is determined by successive approximations by solving FICK's equations. The computer then determines the set dew point $DP_s$ (corresponding to the value $X_d$ in the flow equation). The dew point DP measured in the furnace in which the work pieces are treated is then compared with the set dew point DP. There will be shown hereinafter why only an overall variation of the flow of nitrogen and hydrocarbon permits obtaining both the imposed flow F and a minimized flow of the atmosphere injected into the furnace.

The specification of the user imposes an atmosphere having the following composition permitting the definition of parameters Za, Zb, Zc, Zd such as defined hereinbefore:

900° C. < temperature < 925° C.

0.2% < residual content of CO < 0.4%.

0.5% < residual content of $CH_4$ < 1.0%.

−45° C. (70 ppm) < dew point < −35° C. (220 ppm).

Content of $H_2$ < 5%.

Residual content of $CO_2$ < residual content of $H_2O$.

Experiments are carried out in accordance with the following table on discs of low-alloy steel of grade XC38 (1038) in a testing furnace which is generally different from the industrial furnace or furnaces in which the process according to the invention will be carried out (this is an advantage of the process according to the invention of not relating the control of the atmosphere to a particular type of furnace but solely to the concentration of certain substances of the atmosphere irrespective of the furnace). Each treatment of the work pieces has an identical duration and is usually on the order of one hour.

| Temperature | CO | $CH_4$ | $H_2O$ | Flow of carbon $10^9 \cdot mol \cdot cm^{-2} \cdot s^{-1}$ |
|---|---|---|---|---|
| − | − | − | − | −1.78 |
| + | − | − | − | −1.79 |
| − | + | − | − | −0.57 |
| − | − | + | − | 3.01 |
| − | − | − | + | −7.12 |
| + | + | − | − | −0.44 |
| + | − | + | − | 4.28 |
| + | − | − | + | −8.52 |
| − | + | + | − | 1.73 |
| − | + | − | + | −5.98 |
| − | − | + | + | −3.58 |
| + | + | + | − | 2.93 |
| + | + | − | + | −7.51 |
| + | − | + | + | −4.51 |
| − | + | + | + | −4.29 |

-continued

| Temperature | CO | $CH_4$ | $H_2O$ | Flow of carbon $10^9 \cdot mol \cdot cm^{-2} \cdot s^{-1}$ |
|---|---|---|---|---|
| + | + | + | + | −4.95 |

The right column indicates the result of the calculation of the flow according to the previously given indications. For each experiment, a curve is drawn of the profile of the carbon measured on the treated work pieces and the corresponding flow is calculated, which is the solution of FICK's equations giving the same profile—see FIG. 1. By applying YATES' algorithm, the flow equation is in the present case:

$$F = -2.51 + 1.75X_c - 0.51X_cX_b - (3.41 + 0.45x_a)Xd(1\text{-}0.^9.mol.cm^{-2}.s^{-1})$$

This equation is stored in the memory of the computer which will control the heat treatment process according to the invention by calculating the parameter Xd (dew point $DP_s$) from the values Xa, Xb and Xc measured in the furnace (or more precisely Za, Zb, Zc converted the computer in to Xa, Xb, Xc) and from the imposed set flow $F_s$. The computer effects a sampling at regular intervals of time for measuring Xa, Xb and Xc. This sampling interval, which is generally fixed, is determined by experience for a given furnace.

The invention is carried out in respect of an annealing heat treatment of tubes of steel XC 22 (1022) in a continuous roller furnace.

The decarburization tolerance accepted by the user for said tubes is characterized by a set flow which is such that $F_s = -3 \times 10^{-9}$ mol. $cm^{-2}$ $s^{-1}$ is a specification of non-recarburization and a partial decarburization acceptable at a thickness of 0.1 mm for a period of 30 minutes. This flow was calculated in accordance with the same procedure as that adopted for the flows of the experiment plan (the surface flow is such that the experimental carbon profile of a tube is a solution of FICK's equations—see FIG. 1).

There is injected into the furnace a high flow of 100 $Nm^3/h$ comprising 98.5% $N_2$ and 1.5% natural gas and a low flow of 50 $Nm^3/h$ of a mixture of 98.8% nitrogen and 1.2% hydrocarbon (natural gas) to obtain 1% residual $CH_4$ (value fixed by the user—the aforementioned first variant). This corresponds to 98.8 $Nm^3/h$ of $N_2$ and 1.2 $Nm^3/h$ of $C_xH_y$ at a high flow and 49.25 $Nm^3/h$ of $N_2$ (valve 7) and 0.75 $Nm^3/h$ of $C_xH_y$ (valve 8) at a low flow. These two flows are those which are commanded by the control of the PID type (proportional, integral, derivative) in response to the information communicated thereto by the computer concerning the comparison of the set dew point $DP_s$ and the measured dew point $DP_m$.

When $DP_s$ is lower than $DP_m$, the total flow of nitrogen and natural gas is increased by activating the high flow of the PID control.

When $DP_s = DP_m$ the existing flow is maintained (high or low flow).

When $DP_s$ is higher than $DP_m$, the total flow of nitrogen and natural gas is reduced by activating the low flow of the PID control.

In practice it is found that, under stabilized conditions, the high flow is injected about 70% of the time and the low flow about 30% of the time, namely a mean flow in the furnace on the order of 85 $Nm^3/h$. The treated work pieces satisfy the imposed specification, in particular as concerns the fixed maximum decarburization.

The following table gives a number of examples of situations noted in the course of the treatment of the aforementioned work pieces in the furnace and which illustrate the action of the control according to the process of the invention:

| Temperature (°C.) | % $CH_4$ | % CO | DP (°C.) set | DP (°C.) measured | $F_9$ ($10^9$ mol ; $cm^{-2}s^{-1}$) |
|---|---|---|---|---|---|
| A 910 | 0.7 | 0.3 | −38.5 | −38.5 | −3.0 |
| B 910 | 1.0 | 0.3 | −36.0 | −36.0 | −3.0 |
| C 910 | 1.0 | 0.3 | −36.0 | −35.0 | −4.1 |
| D 910 | 0.7 | 0.3 | −38.5 | −36.0 | −5.1 |
| E 910 | 1.0 | 0.3 | −36.0 | −36.0 | −3.0 |
| F 910 | 1.0 | 0.4 | −36.6 | −36.0 | −3.5 |
| G 910 | 1.0 | 0.4 | −36.6 | −36.6 | −3.0 |

State A: measured in the furnace before optimization

The user arbitrarily fixed a residual ($CH_4$) of 0.7%.

The measurement A indicates that the atmosphere is controlled, i.e. the measured dew point $DP_m$ is equal to the set dew point $DP_s$. However, the computer indicates (flow equation) that the dew point is not maximum in the possible range of variation of the residual $CH_4$. It indicates a maximum for a residual ($CH_4$) = 1.0% (flow equation).

State B

The residual ($CH_4$) was fixed by the operator at 1.0%. The set dew point $DP_s$ is maximum (−36° C.)—the atmosphere flow is reduced. It is minimum because the $DP_s$ is maximum.

State C

The measurement C was effected after the measurement B which represents a minimized stable state it was desired to obtain permanently. This measurement shows the occurrence of a disturbance in the atmosphere of the furnace (for example the introduction of work pieces to be treated, entry of air, etc.) since the measured dew point increases (−35° C.) representing an increase in the humidity of the atmosphere of the furnace. The control according to the invention will therefore act to induce a return to state B by a variation in the overall flow of the injected atmosphere (by acting on the high flow until state E, identical to state B, returns).

State D

By way of comparison, there was attempted in the course of the treatment of the work pieces in the furnace a control by solely increasing the nitrogen flow.

In this case the residual ($CH_4$) is reduced by dilution. The set dew point $DP_s$ diminishes (−38.5° C.), which results in an instability of the control: the control always seeks to catch up with the set $DP_s$ by increasing the nitrogen flow.

This shows the necessity of a control concerning solely the overall flow of nitrogen and hydrocarbon.

State E

Identical to state B.

State F

State F indicates another disturbance produced in the course of the process, due to an increase in the concentration of CO in the atmosphere of the furnace (0.4 instead of 0.3). This results in a variation in the measured flow $(-3.5)\times10^{-9}$ mol.cm$^{-2}$s$^{-2}$ which no longer conforms to the value $F_s$. Consequently, a new set value $DP_s$ (−36.6° C.) is calculated (from the equation stored in the memory) and the overall flow is so adjusted as to return to the stable state C which is different from B.

By way of comparison, there was carried out in this same furnace a treatment of tubes having the same characteristics after annealing by means of an atmosphere created by an exothermic generator. The treatment is carried out at the same temperature and with the same duration but the flow of atmosphere in the furnace is 160 Nm$^3$/h.

The invention therefore permits, for an equal duration of treatment and an identical quality of the work pieces, a large reduction in the flow of the atmosphere injected into the furnace, this reduction being in the present case 47%.

It is of course possible to effect the flows of nitrogen and hydrocarbon as a function of the amplitude of the difference between the measured dew point $DP_m$ and the set dew point $DP_s$.

We claim:

1. A process for heat treating a low alloy steel work piece, comprising heat treating said piece in a furnace to a temperature greater than 600° C. within a protective atmosphere containing $N_2$, $CH_4$ and CO not in thermodynamic equilibrium and having a relative proportion of $CO/CH_4$ between 0.05 and 15 with a residual content of $CH_4$ lower than 2.5% and a residual content of CO lower than 2%, and injecting $N_2$ and a hydrocarbon $C_xH_y$ into the furnace to control said atmosphere, said injection of $N_2$ and hydrocarbon $C_xH_y$ being increased when a measured dew point $DP_m$ in the furnace is greater than a set dew point $DP_s$ calculated from a set flow $F_s$ of transfer of the carbon between the work piece and the atmosphere through the surface of the work piece, said injection of $N_2$ and hydrocarbon $C_xH_y$ being maintained when $DP_m$ is equal to $DP_s$, and said injection of $N_2$ and hydrocarbon $C_xH_y$ being reduced when $DP_m$ is less than $DP_s$.

2. A process according to claim 1, wherein the flow of nitrogen and hydrocarbon is increased or decreased as a function of the amplitude of the difference between the measured dew point $DP_m$ and the set dew point $DP_s$.

3. A process according to claim 1, wherein the protective atmosphere further contains $H_2$ with a residual content of $H_2$ lower than 5%.

4. A process according to claim 1, wherein said atmosphere is controlled by further injecting $H_2$.

5. A process according to claim 1, wherein the injection of $N_2$ and hydrocarbon $C_xH_y$ is increased by changing from a first flow rate to a second flow rate, and the injection of $N_2$ and hydrocarbon $C_xH_y$ is decreased by changing from the second flow rate to the first flow rate, the mean value of the flow rate being determined by the respective durations of the first and second flow rates, said first flow rate being a lower flow rate than said second flow rate.

6. A process according to claim 5, wherein the ratio of the concentrations $(C_xH_y)/(N_2)$ in the first flow rate is different than the ratio of the concentrations $(C_xH_y)/(N_2)$ in the second flow rate.

7. A process according to claim 5, wherein the change from the first flow rate to the second flow rate, and the change from the second flow rate to the first flow rate, of the nitrogen and the hydrocarbon is simultaneous.

8. A process according to claim 5, wherein the change from the first flow rate to the second flow rate, and the change from the second flow rate to the first flow rate, of the nitrogen is independent of that of the hydrocarbon.

9. A process for heat treating a low alloy steel work piece, comprising heat treating said piece in a furnace to a temperature greater than 600° C. within a protective atmosphere containing $N_2$, $CH_4$ and CO not in thermodynamic equilibrium and having a relative proportion of $CO/CH_4$ between 0.05 and 15 with a residual content of $CH_4$ lower than 2.5% and a residual content of CO lower than 2%, and injecting $N_2$ and a hydrocarbon $C_xH_y$ into the furnace to control said atmosphere, said injection of $N_2$ being increased when a measured dew point $DP_m$ in the furnace is greater than a set dew point $DP_s$ calculated from a set flow $F_s$ of transfer of the carbon between the work piece and the atmosphere through the surface of the work piece, said injection of $N_2$ being maintained when $DP_m$ is equal to $DP_s$, and said injection of $N_2$ being reduced when $DP_m$ is less than $DP_s$, and said injection of hydrocarbon $C_xH_y$ being increased when a measured value of residual $CH_4$ is less than a set value of residual $CH_4$, said injection of hydrocarbon $C_xH_y$ being maintained when the measured value of residual $CH_4$ is equal to the set value of residual $CH_4$, and said injection of hydrocarbon $C_xH_y$ being reduced when the measured value of residual $CH_4$ is greater than the set value of residual $CH_4$.

10. A process according to claim 9, wherein the protective atmosphere further contains $H_2$ with a residual content of $H_2$ lower than 5%.

11. A process according to claim 9, wherein said atmosphere is controlled by further injecting $H_2$.

12. A process for heat treating a low alloy steel work piece in a furnace to a temperature greater than 600° C. within a protective atmosphere containing $N_2$, $CH_4$ and CO not in thermodynamic equilibrium and having a relative proportion of $CO/CH_4$ between 0.05 and 15 with a residual content of $CH_4$ lower than 2.5% and a residual content of CO lower than 2%, wherein $N_2$ and a hydrocarbon $C_xH_y$ are injected into the furnace to control said atmosphere, which process comprises:

varying the temperature and the concentrations of CO, $CH_4$ and $H_2O$ at a first minimum value and at a second maximum value for said temperature and concentrations to determine corresponding carbon transfer flows $F=f(T, CO, CH_4, H_2O)$ which correspond to all temperature T and concentrations of CO, $CH_4$ and $H_2O$ between the minimum and maximum values;

measuring the instant values of temperature and concentrations of CO and $CH_4$, and measured dew point $DP_m$ in the furnace; and injecting varying amounts of $N_2$ and a hydrocarbon $C_xH_y$ into the furnace to control said atmosphere dependent upon a calculated set dew point ($DP_s$) corresponding to a desired carbon transfer flow $F_s$ and measured values of temperature and concentrations of CO and $CH_4$, said injection of $N_2$ and hydrocarbon $C_xH_y$ being either increased when the measured dew point $DP_m$ in the furnace is greater than said set dew point $DP_s$, or reduced when $DP_m$ is less than $DP_s$, or maintained when $DP_m$ is equal to $DP_s$.

13. A process for heat treating a low alloy steel work piece according to claim 12, wherein the relative proportion of $CO/CH_4$ is substantially equal to 1.

14. A process for heat treating a low alloy steel work piece according to claim 12, wherein the residual content of CO is about 1%.

15. A process for heat treating a low alloy steel work piece according to claim 12, wherein the residual content of $CH_4$ is about 1%.

16. A process for heat treating a low alloy steel work piece according to claim 12, wherein the temperature is between 680° C. and 1050° C.

17. A process for heat treating a low alloy steel work piece according to claim 12, wherein the set dew point of the atmosphere is between −50° C. and −15° C.

18. A process for heat treating a low alloy steel work piece according to claim 12, wherein the protective atmosphere has a residual content of $H_2$ lower than 5%.

19. A process for heat treating a low alloy steel work piece according to claim 12, wherein the protective atmosphere has a residual content of $CO_2$ lower than that of $H_2O$.

20. A process according to claim 12, wherein the protective atmosphere further contains $H_2$ with a residual content of $H_2$ lower than 5%.

21. A process according to claim 12, wherein said atmosphere is controlled by further injecting $H_2$.

* * * * *